United States Patent [19]

Harley

[11] 4,221,409

[45] Sep. 9, 1980

[54] TAMPERPROOF SHACKLE SEALS

[75] Inventor: David N. Harley, Bournemouth, England

[73] Assignee: ITW Limited, Windsor, England

[21] Appl. No.: 955,077

[22] Filed: Oct. 26, 1978

[30] Foreign Application Priority Data

Nov. 1, 1977 [GB] United Kingdom ..... 45357/77

[51] Int. Cl.[2] ..... B65D 55/06; B65D 27/30; B65D 33/34

[52] U.S. Cl. ..... 292/322; 24/16 PB; 24/30.5 P; 292/319

[58] Field of Search ..... 292/322, 307 R, 318–321; 29/16 PB, 30.5 P; 249/145

[56] References Cited

U.S. PATENT DOCUMENTS

| | | | |
|---|---|---|---|
| 2,206,803 | 7/1940 | Brimhall | 249/145 X |
| 2,840,353 | 7/1958 | Muspratt | 249/145 X |
| 2,979,794 | 4/1961 | Bartolo | 24/16 PB |
| 3,146,012 | 8/1964 | King, Sr. | 292/322 X |
| 3,581,349 | 6/1971 | Verspieren | 24/16 PB |
| 3,954,295 | 5/1976 | Harley | 292/319 |
| 4,082,336 | 4/1978 | Natkins | 292/318 |
| 4,097,966 | 7/1978 | Lefnaer | 24/16 PB |

FOREIGN PATENT DOCUMENTS

| | | | |
|---|---|---|---|
| 1536205 | 1/1970 | Fed. Rep. of Germany | 292/322 |

*Primary Examiner*—William E. Lyddane
*Attorney, Agent, or Firm*—J. R. Halvorsen; T. W. Buckman

[57] ABSTRACT

A tamperproof shackle seal, of the kind including a plug, at one end of a strap, which is self-locking within a socket at the other end of the strap, is capable of use immediately after being integrally moulded in a plastics material, without the need for subsequent manufacturing operations, by virtue of forming a recess set in the wall of the socket into which a barb projecting laterally outwards from the plug is snapped, during use, the plug being formed throughout its length to be of substantially similar transverse cross-section to the socket, and there preferably being a tortuous path presented by ribs/grooves on the plug interengaging with grooves/-ribs of complementary shape on the socket, thereby hampering any attempts to release the seal without causing visible damage.

7 Claims, 6 Drawing Figures

TAMPERPROOF SHACKLE SEALS

The present invention relates to tamperproof shackle seals, and is particularly concerned with those tamperproof shackle seals which are formed in one-piece from a plastics material to present a plug capable of self-locking engagement within a socket, the plug and the socket being formed at the ends of an interconnecting strap whose length is determined primarily by the intended field of application.

It has been usual for the self-locking capability to be achieved by the provision in the socket of several resilient fingers whose free ends, in use, abut an annular shoulder formed at a leading conical end of the plug. A well known manufacturing problem associated with this arrangement is that of ensuring that in moulding the plastics material flows completely to the free ends of the resilient fingers. Moreover, even if the resilient fingers are properly formed, there is the further problem met in use of ensuring that the resilient fingers are not exposed, otherwise they could be readily spread apart to release the plug from the socket. In view of the limitations upon shaping imposed by moulding, due to the need to remove the mould, it has not hitherto been possible to conceal the self-locking capability by forming one end of the socket to be integrally closed. Instead, it has been usual to close one end of the socket after moulding by one or more separate manufacturing operations, such as ultrasonically welding a pivotable flap at the socket end to be closed, or crushing then heat sealing the socket end to be closed. These further manufacturing operations are time consuming and add significantly to the cost of mass production. The aim of the present invention has been to provide a reliable and effective tamperproof shackle seal which can be simply and thus cheaply formed without the need for several manufacturing operations.

According to the present invention, a tamperproof shackle seal constituted by a one-piece plastics moulding comprises a strap, one end of the strap carrying an elongate socket which is defined throughout by an integrally moulded wall, with the other end of the strap carrying an elongate plug which throughout its length is of substantially similar transverse cross-section to the socket, there being an open mouth at one end of the socket to permit insertion of the plug, and there further being a recess set in said integrally moulded wall of the socket into which a barb projecting laterally outwards from the plug is snapped, as a result of such insertion, to hamper any subsequent attempts to release the seal without causing visible damage.

Ideally, the plug is such a close fit within the socket, by virtue of their substantially similar transverse cross-sections, that even a thin blade cannot be inserted therebetween for prising the barb out of its engagement within the recess. Preferably, however, the other end of the socket is at least partially closed by said integrally moulded wall to render access by a thin blade more difficult or even impossible. Moreover, the path presented by the socket between its mouth and its recess is preferably made as tortuous as possible by including a plurality of longitudinally-extending ribs or grooves, so that insertion of any tool for prising the barb from the recess is made as difficult as possible. Although respective longitudinally-extending grooves or ribs of complementary shape would then also need to be formed in the plug, the preferred transverse cross-section of the plug is basically of H-shape for substantially all of its length.

The tamperproof shackle seal preferably includes a tongue projecting from the plug for reception within a slot formed in the otherwise closed end of the socket remote from its open mouth. The purpose of this is to show that the seal has not been broken, and then permanently secured together, extremely small movements of the tongue being visible through the slot when the strap is repeatedly tugged. To indicate that excessive tugging of the strap has occurred, its junction with the plug can be weakened, in a manner known per se, to present in effect a frangible connection.

A particularly preferred method of forming the tamperproof shackle seal, even that whose end of the socket remote from its open mouth is fully closed by said integrally moulded wall, comprises injecting a plastics material into a mould having a single cavity including a removable elongate side core, the recess to be set in the socket being formed by a pin which is itself removably insertable through a laterally extending bore in said side core, such a method avoiding the need for further manufacturing operations.

A tamperproof shackle seal according to the present invention will now be described, by way of example only, with reference to the accompanying drawings, in which.

Figure 2:
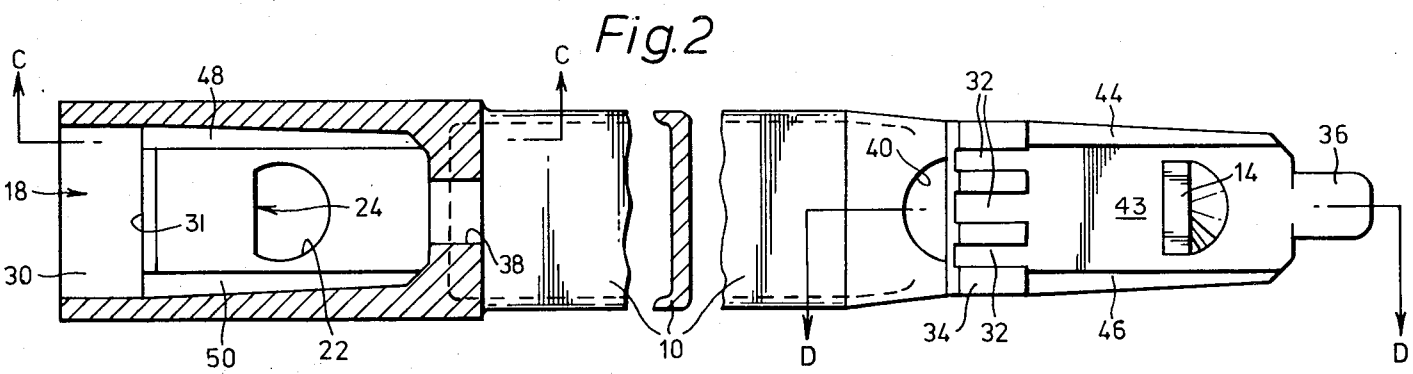
FIG. 2 is a fragmentary plan view of the seal, the socket and a central portion of the strap being shown as horizontal and transverse sections taken, respectively, along the lines A—A and B—B of FIG. 1.
Figure 1:
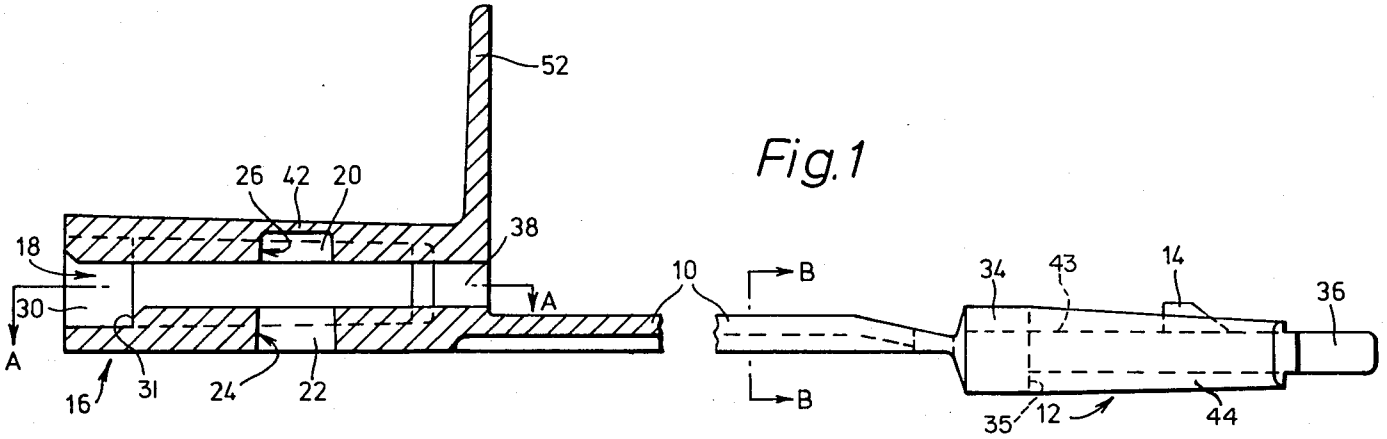
FIG. 1 is a fragmentary side elevation of the seal whose socket and its adjacent length of strap are shown in longitudinal section.
Figure 3:
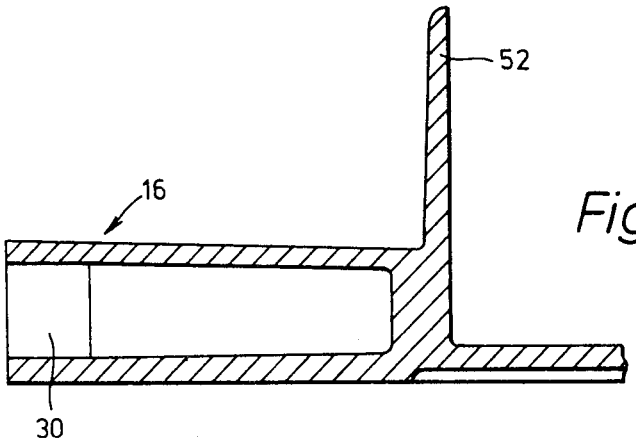
FIGS. 3 and 4 are longitudinal sections taken, respectively, along the lines C—C and D—D of FIG. 2; and, FIGS. 5 and 6 are end elevations taken, respectively, from left and right hand ends of FIG. 1.
Figure 4:
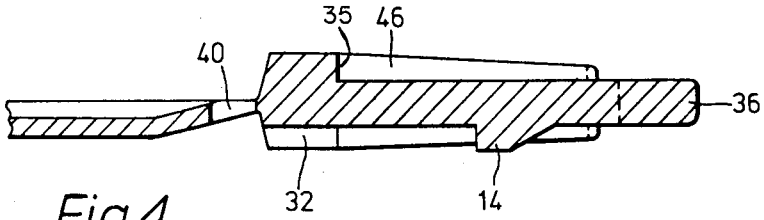
Figure 5:
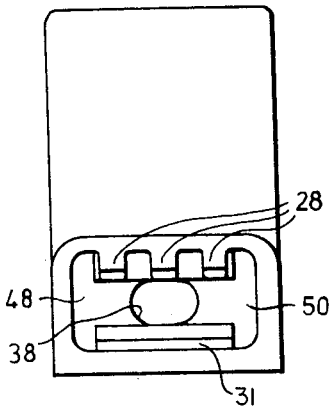
Figure 6:
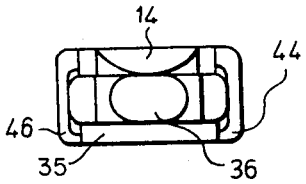

A one-piece plastics moulding constituting a tamperproof shackle seal according to the present invention is shown in the accompanying drawings in its as-moulded condition.

The seal may be injection moulded in the manner described hereinafter in a special two-part mould having a removable side core. Moreover, the seal may be formed of any plastics material conventionally used in this field, ranging from a high melt material such as Nylon 6.6, to a low melt material such as polypropylene which has been reinforced with suitable fillers, for example talcum powder, to increase its heat distortion temperature and/or its resistance to re-welding. A significant advantage of the present seal, compared with the seals hitherto proposed, is that it is ready for use immediately after moulding, but that this ease of manufacture has not resulted in any lessening of the effectiveness of the seal.

The seal includes a strap 10, with one end of the strap 10 carrying an elongate plug 12 having a barb 14 projecting laterally outwards therefrom, and the other end of the strap 10 carrying an elongate socket 16 which is defined throughout by an integrally continuous moulded wall, the plug 12 throughout its length being of substantially similar transverse cross-section to the socket 16, which has an open mouth 18 at one end through which the plug 12 may be inserted and also has a recess 20 set in said integrally moulded wall into which the barb 14 is snapped, as a result of such insertion, to hamper any subsequent attempts to release the seal without causing visible damage.

It will be appreciated that all of the internal outline of the socket 16 is determined during its moulding by the external profile of a removable elongate side core (not shown) apart from the recess 20 and an aligned opposed aperture 22. These are formed by a pin upstanding from one part of a two-part mould (also not shown) which presents a single cavity into which the plastics material is to be injected by using well known techniques. The upstanding pin includes a flat face which causes a shoulder 24 to be formed defining a part of the periphery of the aperture 22, and a shoulder 26 to be formed defining an aligned part of the periphery of the recess 20. The barb 14 is held against the shoulder 26 to prevent release of the plug 12 after its insertion within the socket 16. The sequence of mould assembly and release must clearly allow the upstanding pin to be inserted through and removed from the side core—and consequently the side core must be formed with a laterally extending bore for tightly co-operating with the upstanding rod. The other end of the socket 16, that is to say that end remote from the open mouth 18, can thus be partially or even fully closed by said integrally moulded wall, without the need for further manufacturing operations.

The path presented by the socket 16, between its mouth 18 and its recess 20, is tortuous and includes three longitudinally-extending ribs 28 located within a countersunk portion 30 forming a shoulder 31, although other numbers of ribs or grooves could be provided if desired. Respective grooves 32 of complementary shape in a head portion 34 of the plug 12 plus shoulder means 35 for engaging shoulder 31 of socket 16 are thus necessarily presented to ensure that the transverse cross-section of the plug 12 remains substantially complementary to that of the socket 16 throughout its length. The free end of the plug 12 has a tongue 36 projecting therefrom for reception within a slot 38 formed in that end of the socket 16 remote from its mouth 18. The junction of the strap 10 with the plug 12 includes a hole 40 extending across most of the width of the strap 10, the remaining portion of the junction being further weakened by being formed of thinner crosssection than the thickness of the strap 10 along the rest of its length. A part 42 of said integrally moulded wall covering the recess 20 is also of thin cross-section, being thinner than the remainder of said integrally moulded wall defining the socket 16, so that stress discolouration of said part 42 may occur if deformed. To render access more difficult still the barb 14 projects laterally outwards from an intermediate position along the length of the plug 12. Finally, the plug 12 includes a transverse bar 43 and two side wall flange portions 44 and 46 which, after insertion of the plug 12 within the socket, are located within corresponding spaces 48 and 50 extending from the countersunk portion 30. The plug 12 is thus basically of H-shape in transverse cross-section for substantially all of its length.

The purpose of all of the preferred features of the present invention discussed in the immediately preceding paragraph is to deter thieves by rendering any tampering of the seal to be apparent. Naturally, the proportions of the seal may be altered to suit any particular field of application, such as when wrapped around the neck of a mail bag, when used as a meter seal, or when passed through a padlock and hasp fastening for a lid of a container, and indeed identification tab 52 may be omitted completely if not required.

I claim:

1. A one-piece plastic tamperproof shackle seal including an elongated strap, a generally rectangular female socket extending axially outwardly form one end of said strap and a complimentary male plug extending axially from the other end of said strap, said socket having a substantially H-shaped blind bore that is open at one end and substantially closed at the opposite end, said H-shaped bore providing a pair of slots extending axially along both sides of said socket and joined by a transverse slot, said bore adjacent said open end having an enlarged countersunk mouth terminating in shoulder means spaced from said open end, axially extending guide means opening into said transverse slot, recess shoulder means open at one end and communicating with said transverse slot and axially spaced from said open end a distance greater than the axial extent of said guide means, said male plug having a generally H-shaped cross-section complimentary to and acceptable within said socket bore and including a transverse bar carrying axially extending flanges along opposite edges that extend both above and below said bar, said flanges substantially filling said pair of slots, barb means extending up from said bar and having shoulder means that cooperate with said recess shoulder means, said transverse bar carrying a complimentary enlarged portion including guide means and shoulder means adjacent its juncture to said strap whereby said plug substantially fills the enlarged mouth of said socket, said enlarged portion, said guide means and said flanges forming said plug preventing the introduction of tool means into said socket to disengage said barb from said recess thereby making said shackle tamperproof.

2. A tamperproof shackle seal according to claim 1, in which the other end of the socket is fully closed except for a slot, a tongue projecting from the free end of said plug and complimentarily accepted within said slot.

3. A tamperproof shackle seal according to claim 1, in which the path presented by the socket between its mouth and its recess is tortuous and said guide means includes a plurality of longitudinally-extending rib and groove guides which, in use, engage with respective longitudinally-extending groove and rib guides of complementary shape formed in the plug.

4. A tamperproof shackle seal according to claim 3, in which the plug is basically of H-shape in transverse cross-section for substantially all of its length.

5. A tamperproof shackle seal according to claim 1, in which that part of said integrally moulded wall covering the closed end of said recess is thinner than the remainder of said integrally moulded wall and adapted to display stress marks if unduly distorted.

6. A tamperproof shackle seal according to claim 1, which has been formed by injecting a plastics material into a mould having a single cavity including a removable elongate side core, the recess to be set in the socket being formed by a pin which is itself removably insertable through a laterally extending bore in said side core.

7. A tamperproof shackle seal according to claim 1 wherein said socket includes means angularly disposed relative to the axis of said strap to serve as indicia carrying handle means.

* * * * *